United States Patent [19]

Brockhaus

[11] 4,353,146

[45] Oct. 12, 1982

[54] BUTT HINGE

[75] Inventor: Ernst Brockhaus, Remscheid-Hasten, Fed. Rep. of Germany

[73] Assignee: Ed. Scharwachter GmbH & Co. KG, Remscheid, Fed. Rep. of Germany

[21] Appl. No.: 97,856

[22] Filed: Nov. 27, 1979

[30] Foreign Application Priority Data

Nov. 27, 1978 [DE] Fed. Rep. of Germany ..... 2851234
May 28, 1979 [DE] Fed. Rep. of Germany ..... 2921521

[51] Int. Cl.[3] ..... E05D 5/10

[52] U.S. Cl. ..... 16/387; 16/273; 16/385

[58] Field of Search ..... 16/136, 273, 387, 385; 308/DIG. 9; 252/12.6

[56] References Cited

U.S. PATENT DOCUMENTS

| | | | |
|---|---|---|---|
| 1,076,689 | 10/1913 | McKinney | 16/136 |
| 2,839,779 | 6/1958 | Haag | 16/136 |
| 3,015,126 | 1/1962 | Ahlgren | 16/136 |
| 3,921,225 | 11/1975 | Suska | 16/136 |
| 4,056,478 | 11/1977 | Capelli | 252/12.6 X |

FOREIGN PATENT DOCUMENTS

| | | | |
|---|---|---|---|
| 24411 | 6/1901 | Switzerland | 16/136 |

*Primary Examiner*—Werner H. Schroeder
*Assistant Examiner*—A. Falik
*Attorney, Agent, or Firm*—Toren, McGeady & Stanger

[57] ABSTRACT

A butt hinge includes a first hinge plate with a pair of axially spaced outer gudgeons extending from an edge of the first hinge plate, a second hinge plate with a gudgeon formed of two axially spaced gudgeon sections extending from an edge of the second hinge plate between the outer gudgeons extending from the first hinge plate, and a hinge pin extending through the gudgeons of the first and second hinge plates for pivotally connecting the first and second hinge plates. The pin is fixed against rotation within the outer gudgeons of the first hinge plate, and a bearing bushing within each of the gudgeon sections of the second hinge plate supports the pin for rotational movement about its axis when the first hinge plate is pivotally moved relative to the second hinge plate.

17 Claims, 9 Drawing Figures

BUTT HINGE

The invention relates to a leaf or butt hinge with a hinge pin which is supported so as to require no maintenance, particularly a heavy-duty butt hinge for motor vehicle doors, whose one hinge leaf has two hinge gudgeons which in a fork-like manner embrace the one hinge gudgeon of the other hinge leaf and whose two hinge leaves are pivotally connected to each other by means of a hinge pin, wherein the hinge pin is fixed with a stationary fit in the outer hinge gudgeons of the one hinge leaf while it is supported with a running fit in the one engaging hinge gudgeon of the other hinge leaf through bearing bushings of a maintenance-free plastics material.

In known hinge bearings of this type, the hinge pin is supported in one engaging hinge gudgeon of the other hinge leaf either through two collar bushings of a plastics material which extend over a portion of the height of the hinge gudgeon or by means of a one-piece bushing of a plastics material which extends over the entire height of the hinge gudgeon. In practice, it has been found that, in such hinge pin bearings, condensation water resulting in a corrosive attack on the hinge bearing parts will settle in the middle portion of the one engaging hinge gudgeon. Resulting from the conventional arrangement of motor vehicle door hinges with vertically directed hinge axes is the fact that the principal forces must be transmitted in the regions of the upper and lower ends of the one engaging hinge gudgeon, while, in the middle portion of the one hinge gudgeon, there exists a neutral zone with respect to force transmission in which condensation water can settle even when a single continuous bearing bushing is used. When two short bearing bushings each extending only over a portion of the length of the hinge gudgeon are used, in the middle portion of the hinge gudgeon there remains a free space in which condensation water can settle. It is obvious that the corrosion of the hinge bearing surfaces beginning in the middle portion of the hinge gudgeon will in the course of time also spread to the regions of the hinge gudgeon which transmit forces and, thus, will lead to a gradual destruction of the maintenance-free bearing bushings. Moreover, with progressing corrosion, more and more rust will be washed out of the hinge gudgeon, the rust subsequently leading to unsightly discolorations of the vehicle. It is especially disadvantageous in this connection that, in these known hinges with maintenance-free supports, the bearing surfaces attacked by the corrosion are not accessible so that the corrosion damages cannot be eliminated.

Moreover, the use of one-piece bearing bushings extending over the entire length of the hinge gudgeon has the disadvantage that these bearing bushings and their assembly are relatively cumbersome. In mass produced articles such as these motor vehicle door hinges, additional costs are not acceptable even when they are not very high.

Starting from this state of the art, the invention is based on the task of further improving a butt hinge with a hinge pin which is supported so as to require no maintenance, particularly a heavy-duty motor vehicle door hinge of the above-identified type, in such a manner that not only the above-described disadvantage of corrosion is avoided, but also a more economical production is achieved while using less material and obtaining a lighter weight and that, further, the bore walls of the gudgeon bores are essentially protected against corrosion to be expected as a result of the settlement of condensation water.

In a butt hinge with a hinge pin which is supported so as to require no maintenance, particularly in a heavy-duty motor vehicle door hinge, this task is solved in accordance with the invention thereby that in the one engaging hinge gudgeon there is arranged a central, transversely extending recess and that the hinge pin is pivotally supported through two bushings which are arranged at a distance between each other. The length of the central, transversely extending recess in the one hinge gudgeon of the other hinge leaf advantageously is a third of the entire length of the hinge gudgeon.

Since, in motor vehicle door hinges, practically no forces are transmitted in the middle portion of the one engaging hinge gudgeon, the hinge is not weakened by the central, transversely extending recess according to the invention. However, on the other hand, this recess leads to a significant reduction of the weight of the hinge which is a substantial advantage with respect to modern light-weight construction in the production of vehicles. Simultaneously, the central, transversely extending recess in the one engaging hinge gudgeon also prevents the formation of condensation water within the hinge gudgen bore and the resulting corrosion of the hinge bearing surfaces. Another significant advantage of the hinge design according to the invention is to be seen in the fact that the one engaging hinge gudgeon now has only two short hinge gudgeon sections which can be bored from two sides and with intermittent feed. Accordingly, the expensive deep hole boring which is required in conventional motor vehicle door hinges if they are made of hinge sections is avoided in the butt hinge according to the invention. In total, this results in a significant reduction of the production expenses required for such a hinge.

In accordance with another feature of the invention, the bushings which support the hinge pin in the one hinge gudgeon of the other hinge leaf are constructed as collar bushings and embrace with their collars one of the business or bearing surfaces of the hinge gudgeon while, with their free cylindrical ends, they slightly project beyond the oppositely located end faces of the central, transversely extending recess in the hinge gudgeon.

In accordance with the invention, the collar bushings supporting the hinge pin are made of a solid, load-bearing plastics material which withstands high surface pressures, such as polyamide or Teflon or the like. However, the collar bushings can also be made of a bronze or textile fabric with corresponding compressive strength and can be provided with a Teflon coating.

In accordance with another feature of the invention, it is provided that the gudgeon bore is provided with a continuous rust preventing lining which adheres to or rests against the bore wall. The rust preventing lining is formed by an application of corrosion-resistant materials which adhere to the bore wall of the gudgeon bore and is applied on the bore wall over the entire length of the gudgeon bore prior to the insertion of the bearing bushings of maintenance-free plastics material.

Of course, various materials and manners of application for the production of the rust preventing lining are possible. The rust preventing lining can be particularly formed by a chemical surface application, for example, the application of a rust preventing special lacquer or other, known and suitable, chemical and rust preventing agents, wherein the manner of application to be used is adjusted to the respective special requirements of the rust preventing agent used in the respective case.

In accordance with another feature of the invention, the rust preventing lining can also be formed by a metallic surface application, such as chromium plating, galvanizing or the like, which is to be applied on the bore wall of the hinge gudgeon, wherein, according to the invention, such a manner of application is to be used which ensures a permanent connection between the metallic surface application and the bore wall, for example, a galvanic application or the application of the metallic surface application by means of flame spraying or the like.

In accordance with another feature of the invention, the rust preventing lining can also consist of a surface application of a suitable plastics material, wherein the plastics material is to be applied on the bore wall in a manner which is suitable for the material.

Independently from the selection of the material to be applied for the production of the rust preventing lining, the manner of application must be chosen in such a way that an absolutely air-tight and water-tight contact of the surface application of the bore wall is ensured uniformly over its entire surface. Only in this manner, it can be ensured that a possible settlement of condensation water in the inner regions of the gudgeon bore of the central, engaging hinge gudgeon of the other hinge leaf cannot lead to a corrosion of the gudgeon bore walls.

In accordance with a special feature of the invention, it can be further provided that the rust preventing lining is formed by a section of tube or hose material which possibly bridges a transversely directed central recess in the hinge gudgeon and is pressed with a high surface pressure in an air-tight and water-tight manner against the bore wall. The section of tube material forming the rust preventing lining may consist of metal, such as surface-protected steel or the like, but also of a plastics material. If the rust preventing lining consists of a section of a semi-finished product of plastics material, it can also be formed by a section of hose material. In any case, it is important that the rust preventing lining bears in a water-tight and air-tight manner over its entire surface against the bore wall.

In the following, the invention shall be described in detail with the aid of two embodiments illustrated in the drawing.

Figure 1:
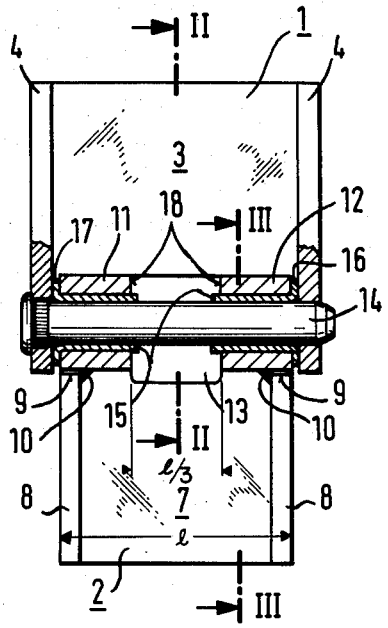
FIG. 1 shows a partially sectional top view of a sheet metal hinge.
Figure 4:
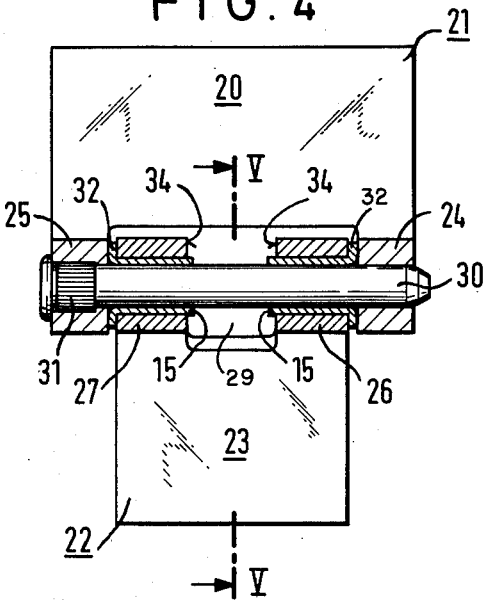
FIG. 4 shows a partially sectional top view of a butt hinge constructed with hinge sections.
Figure 7:
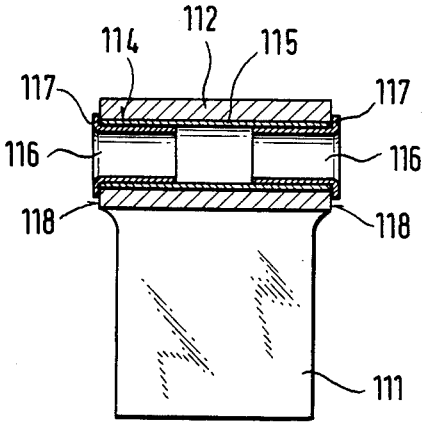
Figure 8:
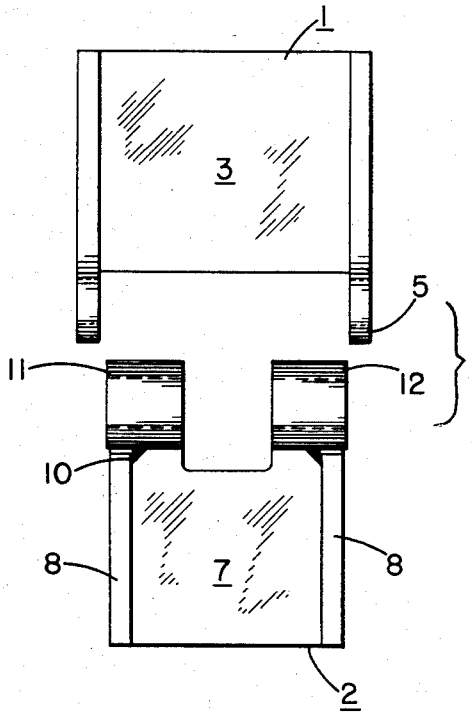
Figure 9:
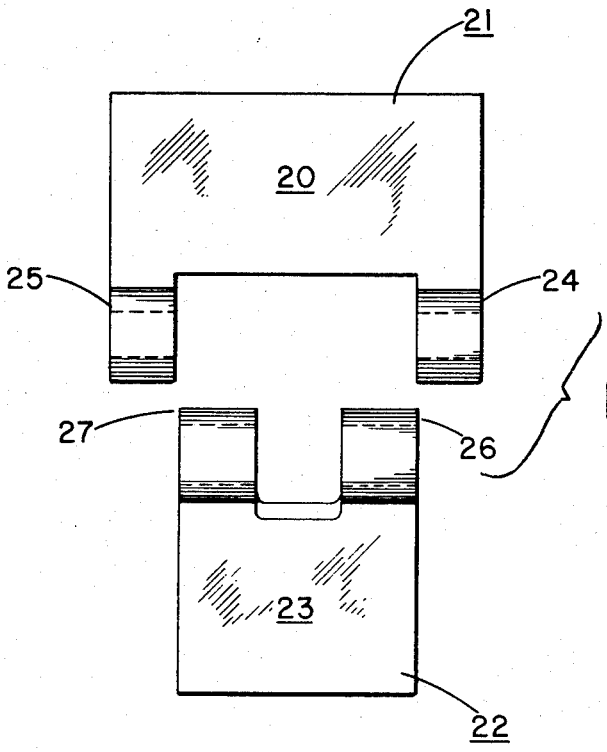

FIG. 7 also shows a partially sectional side view of another embodiment of a hinge leaf constructed in accordance with the invention, with a concentric, engaging hinge gudgeon;

FIG. 8 is a schematic showing of the hinge leaves of the sheet metal hinge shown in FIG. 1 with the hinge pin removed and the leaves spaced apart; and FIG. 9 is a schematic showing of the hinge leaves of the sheet metal hinge shown in FIG. 4 with the hinge pin removed and the leaves spaced apart.

Figure 2:
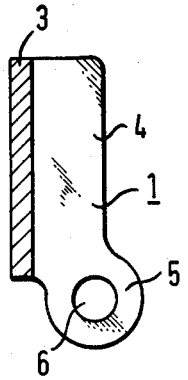
FIG. 2 shows a section taken through FIG. 1 along the line II—II.
Figure 3:
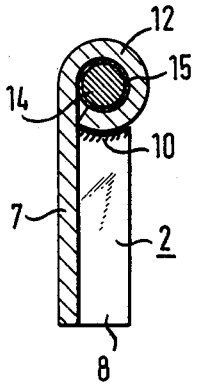
FIG. 3 shows a section taken through FIG. 1 along the line III—III.

In the embodiment illustrated in FIGS. 1 to 3, the two leaves 1 and 2 of the butt hinge each consist of a sheet metal stamping having a U-shaped cross section. On the section flanges 4 extending perpendicularly relative to its section base or web 3 of the one hinge leaf 1 there are free-cut lugs 5 which project beyond the section web 3 and on which there is arranged a hinge gudgeon bore 6. The hinge gudgeons 5/6 of the one hinge leaf 1 form the outer hinge gudgeons which embrace in a fork-like manner the inner hinge gudgeon of the other hinge leaf 2. The edge of the hinge leaf 1 extending between the hinge gudgeons 5,6 is a first edge and the flanges 4 form second edges extending transversely of the first edge. In the illustrated embodiment, the other hinge leaf 2 also consists of a sheet metal stamping having a U-shaped cross section whose section flange 8 extending perpendicularly relative to its section web 7 forms a support for the hinge gudgeon. The hinge gudgeon of the other hinge leaf 2 if formed by lugs which are rolled-in by approximately 360° and are free-cut in the extension of the section web 7 of the hinge leaf 2, these lugs being fastened to the front edges 9 of the section flanges 8 by means of welds 10. A centrally arranged recess 13 is provided in the hinge gudgeon 11/12 of the other hinge leaf 2 which engages between the two outer hinge gudgeons 5/6 of the hinge leaf 1. The edge of the hinge leaf 2 along which the gudgeon sections 11, 12 extend is the third edge and the edges extending transversely of the third edge are the fourth edges. The dimension between the fourth edges is l, while the axial length of the recess between the two gudgeon sections 11, 12 is one-third ($\frac{1}{3}$) l. As a result of this recess 13, the formation of condensation water and, thus, the corrosion within the hinge gudgeon are avoided. In the two sections 11 and 12 of the engaging hinge gudgeon 2 there is supported a hinge pin 14 with a running fit by means of collar bushings 15. In the illustrated embodiment, the collar bushings 15 consist of a pressure-proof, load-bearing and solid plastics material and embrace the bearing surfaces 16 of the hinge gudgeons 11 and 12. The bushings 14 each slightly project belong the oppositely located end faces 17 and 18 of the recess 13. The hinge pin 14 is arranged in the outer, projecting hinge gudgeons 5/6 of the one hinge leaf 1 with a stationary or tight fit and is non-rotatably fixed in one of these hinge gudgeons by means of a knurl 19. In FIG. 8 the hinge leaves 1, 2 are shown with the hinge pin removed and spaced outwardly from one another.

Figure 5:
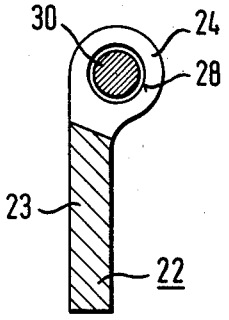
FIG. 5 shows a section taken through FIG. 4 along the lines V—V.

The hinge leaves 21 and 22 of the hinge illustrated in FIGS. 4 and 5 are each constructed from a conventional hinge section. In addition to a strike plate 20, the hinge section has a head roll 24 in which the hinge gudgeons 25 and 26/27 are formed by free cutting. In the head roll 24 of the hinge section there is further arranged a hinge gudgeon bore 28. The two outer hinge leaf or gudgeons 25 of the one hinge half 21 are formed by free-cutting and boring of the head roll 24 of a hinge section. The hinge leaf or gudgeon 26/27 of the other hinge half 22 engaging between the two outer hinge gudgeons 25 of the one hinge half 21 is divided by means of a central, transversely extending recess 29 in the two hinge gudgeon sections 27 and 26. The two hinge leaves 21 and 22 are pivotally connected to each other by means of a hinge pin 30 which extends through the hinge gudgeons 25 to 27, wherein the hinge pin 30 has a stationary fit in the outer hinge gudgeons 25 of the one hinge leaf 21 and is non-rotatably fixed by means of a knurl 31. By means of plastic material bushings 15 constructed as collar bushings, the hinge pin 30 is freely rotatably supported in the hinge gudgeon sections 26 and 27 of the other hinge leaf 22. The collar bushings 15 overlap with their collars the outer bearing surfaces 32 of the hinge gudgeon sections 27 and 26, while, with their free cylindrical ends, they slightly project beyond the inner, oppositely located end faces 33 and 34 of the recess 29. Especially the embodiment of the invention illustrated in FIGS. 4 and 5 makes clear that the design of a motor vehicle door hinge in accordance with the invention not only results in a significant weight reduction, but also in a substantial simplification of the production since, with respect to the engaging hinge gudgeon of the other hinge leaf 22, a deep hole boring is avoided and, on the contrary, the hinge gudgeon boring can be performed from two sides and with intermittent feed. Moreover, in both embodiments illustrated in the drawing it is possible to use two short bearing bushings which are constructed as collar bushings which are significantly less expensive in the production as well as in the assembly as compared to conventional continuous bearing bushings.

In FIG. 9 the hinge leaves 21, 22 are shown with the hinge pin removed and spaced outwardly from one another.

Figure 6:
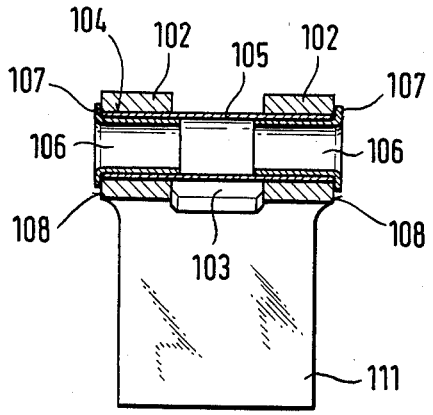
FIG. 6 shows a partially sectional side view of a special embodiment of a hinge leaf constructed in accordance with the invention with a concentric, engaging hinge gudgeon.

In FIG. 6, the hinge gudgeon 102 of the hinge leaf has a central recess 103 directed transversely to the hinge axis which prevents a formation of condensation water and, thus, a corrosion of the bore walls 104 of the gudgeon bore in the hinge gudgeon 102 at least in the central portion. The hinge gudgeon 102 is provided with a continuous rust preventing lining 105 which bears in an air-tight and water-tight manner against the bore wall 104 of the hinge gudgeon bore. In the illustrated embodiment, the rust preventing lining 105 is formed of a section of tube material and is inserted with high surface pressure into the hinge gudgeon 102. The rust preventing lining 105 formed from a section of tube material bridges the recess 103 in the hinge gudgeon 102 which is directed transversely to the hinge axis. In the rust preventing lining 105 there are inserted bushings of a pressure-proof, load-bearing and maintenance-free plastics material which, in the illustrated embodiment, are constructed as collar bushings 106 and form the running fit for the hinge pin. With their collars 107, the collar bushings 106 each partially embrace the end faces 108 of the hinge gudgeon 107.

In the embodiment illustrated in FIG. 7, on a hinge leaf 111 there is arranged a concentric, engaging hinge gudgeon 112 whose gudgeon bore is provided with a rust preventing lining 115. The rust preventing lining 115 consists of a section of tube material which extends continuously over the entire length of the hinge gudgeon bore and is pressed in an air-tight and water-tight manner against the bore walls 114 of the hinge gudgeon bore. The bushings of a load-bearing, pressure-proof and maintenance-free plastics material which, in the illustrated embodiment, are constructed as collar bushings 116 and form the running fit for the hinge pin are inserted in the rust preventing lining 115 and, with their collars 117, embrace at least partially the end walls 118 of the hinge gudgeon 112.

In the illustrated embodiments, the rust preventing lining 105 or 115 is formed by a section of a tube or hose material of metal or plastics material, however, particularly the illustration of FIG. 2 clearly shows that the rust preventing lining 115 can also be formed by a surface application of a chemical material, such as rust preventing special lacquer, or a surface application of metal, such as chromium or zinc.

I claim:

1. A butt hinge having a hinge axis and comprising a first hinge plate and a pair of axially spaced outer gudgeons extending outwardly from an edge of said first hinge plate extending generally parallel to and spaced laterally from the hinge axis, a second hinge plate and a single inner gudgeon extending outwardly from an edge of said second hinge plate extending generally parallel to and spaced laterally from the hinge axis with said inner gudgeon extending between and axially aligned with said outer gudgeons of said first hinge plate, said inner gudgeon of said second hinge plate being formed by two axially spaced inner gudgeon sections and with the adjacent ends of said inner gudgeon sections in combination with said edge from which said inner gudgeon sections extend defining a recess, said recess and said first plate edge being so dimensioned that when a a hinge pin extends through said pair of outer gudgeons of said first plate said two inner gudgeon sections of said second plate and said recess between said inner gudgeon sections for pivotally connecting said first and second hinge plates to provide the hinge axis only said hinge pin extends through said recess with said first plate edge being outside thereof, said pin being fixed against rotation with said outer gudgeons of said first plate, a bearing bushing within each of said inner gudgeon sections of said second plate for supporting said pin for rotational movement about its axis when said first plate is pivotally moved relative to said second plate about the hinge axis, said bearing bushings each projecting into said recess and located in spaced relation to one another in the axial direction of said hinge axis and said recess between said inner gudgeon sections extends for about one-third of the overall axial length of said inner gudgeon on said second hinge plate.

2. A butt hinge according to claim 1, wherein each of said bushings has a collar at one of its ends and said inner gudgeon sections have outer bearing surfaces which face toward said outer gudgeons of said first plate, said collars of said bushings project from and extend over said outer bearing surfaces.

3. A butt hinge according to claim 2, wherein said bushings each have a free cylindrical end which projects toward the other into said recess for a given distance beyond the length of said inner gudgeon sections along said hinge axis.

4. A butt hinge according to claim 2, wherein said bushings are formed of a plastics material.

5. A butt hinge according to claim 2, wherein said bushings are formed of load bearing bronze.

6. A butt hinge according to claim 2, wherein said bushings are formed of a textile fabric having a coating of Teflon.

7. A butt hinge according to claim 4, wherein said plastics material comprises polyamide.

8. A butt hinge according to claim 4, wherein said plastics material comprises Teflon.

9. A butt hinge having a hinge axis and comprising a first hinge plate having a first edge extending generally parallel with said hinge axis and a pair of second edges spaced apart along the hinge axis at the opposite ends of said first edge, an outer gudgeon located at each of said second edges with said outer gudgeons centered on said hinge axis, a second hinge plate having a third edge extending generally parallel with said hinge axis and a pair of fourth edges spaced apart along said hinge axis and located at the opposite ends of said third edge, an inner gudgeon formed along said third edge and centered on said hinge axis, said third edge has a length at least slightly less than the spacing between said outer gudgeons so that said third edge fits and extends between said outer gudgeons, said inner gudgeon is located between said outer gudgeons and has a length along said hinge axis approximately equal to the length of said third edge, said inner gudgeon comprising two inner gudgeon sections spaced apart in the axial direction of said hinge axis with each said inner gudgeon section extending from different one of said fourth edges toward the other said inner gudgeon section, the adjacent ends of said inner gudgeon sections are spaced apart and form an open recess therebetween so that the formation of condensation water within said butt hinge is avoided, a hinge pin extending continuously between said pair of outer gudgeons of said first plate and extending through said inner gudgeon sections of said second plate for pivotally connecting said first and second hinge plates and forming said hinge axis, said pin is fixed against rotation in at least one of said outer gudgeons of said first plate, a bearing bushing within each of said inner gudgeon sections of said second plate for supporting said pin for rotational movement about its axis when said first plate is moved pivotally relative to said second plate, said first edge of said first hinge plate is spaced radially outwardly from said hinge pin and said third edge of said second hinge plate between said inner gudgeon sections is spaced radially outwardly relative to the hinge axis from the axial extending outer surfaces of said inner gudeon sections.

10. A butt hinge, according to claim 9, wherein said open recess between said inner gudgeon sections extends about one-third the overall axial length between said fourth edges of said second hinge plate.

11. A butt hinge according to claim 10, wherein each of said bushings has a collar at one of its ends and said inner gudgeon sections have outer bearing surfaces which face toward said outer gudgeons on said first plate, and said collars of said bushing extend over said outer bearing surfaces.

12. A butt hinge according to claim 11, wherein said bushings are formed of load bearing bronze.

13. A butt hinge according to claim 11, wherein said bushings are formed of textile fabric having a coating of Teflon.

14. A butt hinge according to claim 11, wherein said bushings have free cylindrical ends which project toward one another a given distance beyond the length of said inner gudgeon sections along said hinge axis.

15. A butt hinge according to claim 14, wherein said bushings are formed of a plastics material.

16. A butt hinge according to claim 15, wherein said plastics material comprises polyamide.

17. A butt hinge according to claim 15, wherein said plastics material comprises Teflon.

* * * * *